US005342141A

United States Patent [19]

Close

[11] Patent Number: 5,342,141

[45] Date of Patent: Aug. 30, 1994

[54] MOVABLE SURFACE PAVING APPARATUS AND METHOD FOR USING THE SAME

[76] Inventor: Darrell R. Close, P.O. Box 556, Sutter, Calif. 95982

[21] Appl. No.: 28,985

[22] Filed: Mar. 10, 1993

[51] Int. Cl.[5] ..... E01C 3/00; E01C 23/06

[52] U.S. Cl. ..... 404/28; 404/29; 404/37; 52/386

[58] Field of Search ..... 404/18, 73, 76, 75, 404/27, 28, 31, 33, 43, 44, 35, 36, 37, 29; 292/2, 86; 52/450–454, 676, 386

[56] References Cited

U.S. PATENT DOCUMENTS

| | | | |
|---|---|---|---|
| 112,239 | 2/1871 | Grant . | |
| 123,219 | 1/1872 | Beidler . | |
| 321,403 | 6/1885 | Underwood . | |
| 442,784 | 12/1890 | Schmidt | 404/43 |
| 658,868 | 10/1900 | Rosenbaum . | |
| 917,859 | 4/1909 | Fusch | 52/676 |
| 1,572,854 | 2/1926 | Clark et al. | 404/44 X |
| 1,646,997 | 10/1927 | Gelder | 404/27 |
| 1,938,644 | 12/1933 | Swanson | 404/31 |
| 1,970,037 | 8/1934 | Fischer | 404/33 X |
| 2,245,689 | 6/1941 | Krueger | 52/450 |
| 3,148,482 | 9/1964 | Neale . | |
| 3,496,691 | 2/1970 | Seaburg et al. | 52/450 X |
| 3,577,895 | 5/1971 | Carlin | 404/35 X |
| 3,581,631 | 6/1971 | Samson | 404/75 |
| 3,905,172 | 9/1975 | Blackburn . | |
| 4,047,825 | 9/1977 | Lundahl . | |
| 4,531,859 | 7/1985 | Bettigole | 404/44 X |
| 4,813,811 | 3/1989 | Adams . | |

FOREIGN PATENT DOCUMENTS

| | | |
|---|---|---|
| 540850 | 8/1955 | Belgium . |
| 244504 | 8/1924 | United Kingdom . |
| 373715 | 4/1931 | United Kingdom . |

*Primary Examiner*—Thuy M. Bui
*Assistant Examiner*—James A. Lisehora
*Attorney, Agent, or Firm*—John P. O'Banion; John Costello

[57] ABSTRACT

A surface paving apparatus (10) and a method for using the apparatus is disclosed herein. The apparatus is comprised of a mesh material (12) having parallel ribs (14) attached, laid upon a surface to be paved. A paving material (16) with grooves (24) cut into its underside is then placed upon the mesh material (12) such that the ribs (14) on the mesh material (12) frictionally engage the grooves (24) on the paving material (16). The frictional engagement between the grooves (24) and ribs (14) is stable enough to render the paving surface laterally immovable from any direction. The surface paving apparatus (10) can also be disassembled and moved, should this be desired.

13 Claims, 4 Drawing Sheets

MOVABLE SURFACE PAVING APPARATUS AND METHOD FOR USING THE SAME

BACKGROUND OF THE INVENTION

1. Field of the Invention

This invention relates generally to surface paving, and more particularly to a surface paving apparatus which can be easily assembled into an immovable, durable, surface and which can be subsequently disassembled and moved.

2. Description of the Background Art

When civilization arose, so arose the necessity for paved surfaces to facilitate the movement of people and the goods of commerce. In general, the utilitarian requirements of a reliable paved surface have been that it remain immovable in the face of heavy traffic, that it be durable in the face of the elements, that it be adaptable to varying terrain and soil conditions, that it provide for adequate drainage and that it be simple to maintain. To achieve the requirement of immovability, most prior art paving surfaces have employed borders of rock or cement, to hold the paving material in place, or else in addition to borders, have used packed sand, or some other suitable material placed in between the sections of paving material, to achieve the requirement of immovability.

For example, British Pat. No. 244,504 applied for by Cardell, on Aug. 19, 1924, discloses a paving surface comprised of grooved paving blocks, wherein the grooves are designed to accommodate the bars of a structural "rebar" lattice, laid upon a roadbed. Wet cement or mortar is poured into the rebar lattice and the paving blocks are set upon the wet cement, such that the grooves settle upon the bars of the lattice, thereby bonding the blocks, rebar lattice and cement, together.

Belgian Pat. No. 540850 applied for by Desmedt et. al. on Aug. 27, 1955, discloses a tile laying apparatus wherein the tile have wide channels on their undersides. A series of rods are placed in the channels for purposes of aligning adjacent pieces of tile. Once the tile is laid and aligned, the rods are removed.

U.S. Pat. No. 123,219 issued to Beidler on Jan. 30, 1872, discloses a wooden paving surface comprised of wedge-shaped wooden blocks, cut away at the outer edges, to form a tenon and shoulder, which allows the blocks to rest upon strips laid parallel with the street. The spaces between the blocks are then filled with gravel, sand, tar, or pitch, to create an immovable surface.

U.S. Pat. No. 112,239 issued to Grant on Feb. 28, 1871, discloses a wood pavement comprised of a set of grooved upper and lower blocks; the lower blocks being set upon the road bed and the upper blocks serving as the road surface. The blocks are joined by the nature of their interlocking grooves, as well as by a system of hooks which wrap around the grooves, to form a sturdy paving surface. Any spaces between the blocks are then filled with sand or gravel to create an immovable surface.

British Pat. No. 373,715 applied for by Russell on Apr. 1, 1931, discloses a wooden pavement surface comprised of a series of wooden blocks with grooved bottoms. The grooves in the bottoms of the blocks match the configuration of a series of ribs laid upon the surface to be paved, such that when the ribs are matched to the grooves, they become interlocked, thereby holding the blocks in position.

U.S. Pat. No. 3,148,482 issued to Neale on Sep. 15, 1964, discloses a composite floor structure comprised of bricks laid upon a metal grid. At intervals, the grid has projections which are spaced according to the width of the bricks used. When the bricks are placed between the projections on the grid, the projections abut against the edges of tile bricks, such that the bricks are held fast between the projections.

U.S. Pat. No. 4,047,825 issued to Lundahl on Sep. 13, 1977, discloses a pavement apparatus comprised of a wire grid, possessing brick-size grid spaces, which may be transported, or stored on a roll and when unrolled onto a flat path, the bricks can subsequently be individually mounted in each of the grid spaces. Sand or mortar can then be driven into the spaces between the bricks, to create an immovable surface.

U.S. Pat. No. 4,813,811 issued to Adams on Mar. 21, 1989, discloses a prefabricated pavement device which has a support layer consisting of wire or plastic mesh.

U.S. Pat. No. 3,905,172 issued to Blackburn on Sep. 16, 1975, discloses a method for laying wooden floors, wherein slices of wood material are placed on an asphalt or bitumen foundation and then adhesives are poured between the slices of wood material to fill in any gaps.

The foregoing paving surfaces achieve a degree of permanence which make it difficult for them to be moved once they are in place. Should a need arise for these paving surfaces to be moved, movement can only be achieved through a significant expenditure of energy and by incurring damage to the paving surface itself, thereby necessitating replacement of whole or part of the surface with an entirely new paving surface. Attempts to create a surface which is durable and immovable in place, yet which can be easily disassembled and moved, have met with marginal success.

U.S. Pat. No. 321,403 issued to Underwood on Jun. 30, 1885, describes a system of grooved paving blocks adapted to be assembled upon a series of ribbed base plates. The ribbed plates serve as a base material and have perforations to allow for drainage. The grooves in the paving blocks accommodate the ribs on the baseplate, allowing for the assembly of a paving surface, by placing numerous blocks over the ribs on the base plates. The outermost ribs on the base plates are half as wide as the center ribs, specifically so that two base plates can be joined by fitting a grooved paving block over the outermost ribs of the two adjoining base plates, effectively locking them together. This design was created so that whole sections of pavement could be removed by merely lifting the blocks off the ribs and subsequently removing the baseplates, should a section of road bed or sewer beneath the pavement require repair. While Underwood allows for the disassembly and removal of small sections of pavement, the cumbersome and rigid nature of the base plates, make it difficult to disassemble and move the entire pavement in a quick and efficient manner.

U.S. Pat. No. 658,868 issued to Rosenbaum on Oct. 2, 1900 discloses an improvement in securing vitreous slabs to walls, floors or ceilings. In Rosenbaum, the wall, floor, or ceiling to be covered, possess parallel, hollow, dovetailed ridges, the parallel nature of the ridges thereby creating channels. The vitreous slabs are pressed into the channels and are held secure by the spring-like characteristics of the hollow dovetailed ridges. While it may be inferred that the spring-like nature of the dovetailed ridges allow for simple disassembly of the invention, it is not specifically stated as such. Also, in Rosenbaum, no mention is made of the utility of this invention for use as a pavement surface.

A need therefore still exists for a paving surface which is durable and immovable when in place, yet which can be easily disassembled, moved, and reassembled in another location without incurring any damage to the paving surface. Additionally, it is also important that a movable paving surface be free from weeds and plants, which can protrude through the joints of the paving surface and degrade it. The surface paving apparatus disclosed herein, satisfies these requirements.

The foregoing patents reflect the state of the art of which the applicant is aware and are tendered with the view toward discharging applicant's acknowledged duty of candor in disclosing information which may be pertinent in the examination of this application. It is respectfully stipulated, however, that none of these patents teach or render obvious, singly or when considered in combination, applicant's claimed invention.

SUMMARY OF THE INVENTION

The present invention pertains to a surface paving apparatus and a method for using the same. By way of example and not of limitation, the surface paving apparatus is comprised of a mesh material for covering a surface to be paved, a plurality of ribs fastened to the mesh material, and a grooved paving material which frictionally engages the ribs of the mesh material, thereby holding the paving material in an immobile position. The mesh material preferably is a mesh fabric of a type commonly selected for landscaping, which has the favorable characteristics of providing excellent drainage and preventing the growth of plants which can degrade the paving surface. The ribs, being preferably substantially elongate and substantially parallel, may be fastened to the mesh material by any variety of fastening means. The paving material has grooves placed upon its surface either by cutting or extruding. The ribs and grooves are designed to engage each other in a tight frictional fit. This frictional engagement is of such a nature that, when the paving material is pressed down upon the ribs, a tight fit is achieved between the grooves and vinyl strips on the ribs. The paving material may be a series of paving blocks comprised of materials commonly used in the paving arts. One other notable feature of the surface paving apparatus, is that the paving material is detachably coupled to the mesh material and can be uncoupled at will.

The method of using the present invention involves placing the mesh material upon a surface to be paved. The ribs may be attached to the mesh material either prior to, or after, placing the mesh material upon the surface to be paved. The grooves in the paving material may be placed there either prior to practicing the invention, or else may be placed there as part of an invention step, by extruding or cutting. Once the ribs and grooves are in place, the person practicing this method places the grooves of the paving material upon the ribs on the mesh material and, using adequate pressure, pushes down upon the paving material until a tight frictional engagement is achieved between the ribs and the grooves.

An object of the invention is to provide a paving surface which is durable and which can be easily disassembled, moved and reassembled at will.

Another object of the invention is to provide a paving surface which is impervious to weeds or other plants which can degrade a paving surface.

Another object of the invention is to provide a paving surface wherein the paving material is held to the remainder of the surface paving apparatus by an immovable, frictional engagement.

Another object of the invention is to provide a paving surface which is adaptable to sloped surfaces and remains immobile thereon.

Still another object of the invention is to provide a paving surface where the paving material is readily detachable from the remainder of the surface paving apparatus.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
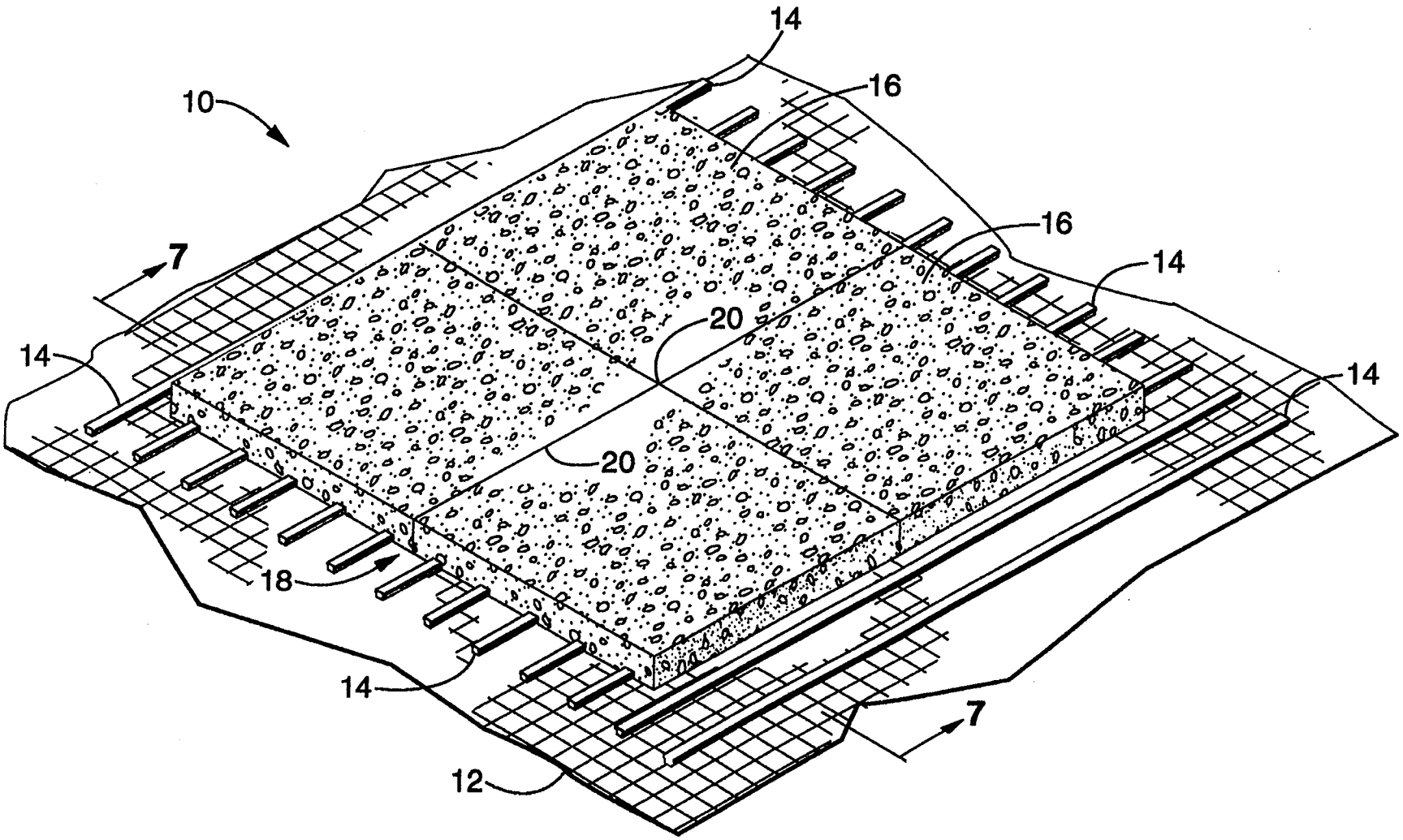
FIG. 1 is a perspective view of the apparatus embodying the present invention.

Referring more specifically to the drawings, for illustrative purposes the present invention is embodied in the apparatus generally shown in FIG. 1. It will be appreciated that the apparatus may vary as to configuration and as to details of the parts and that the method may vary as to the details and sequence of steps without departing from the basic concepts as disclosed herein.

Figure 2:
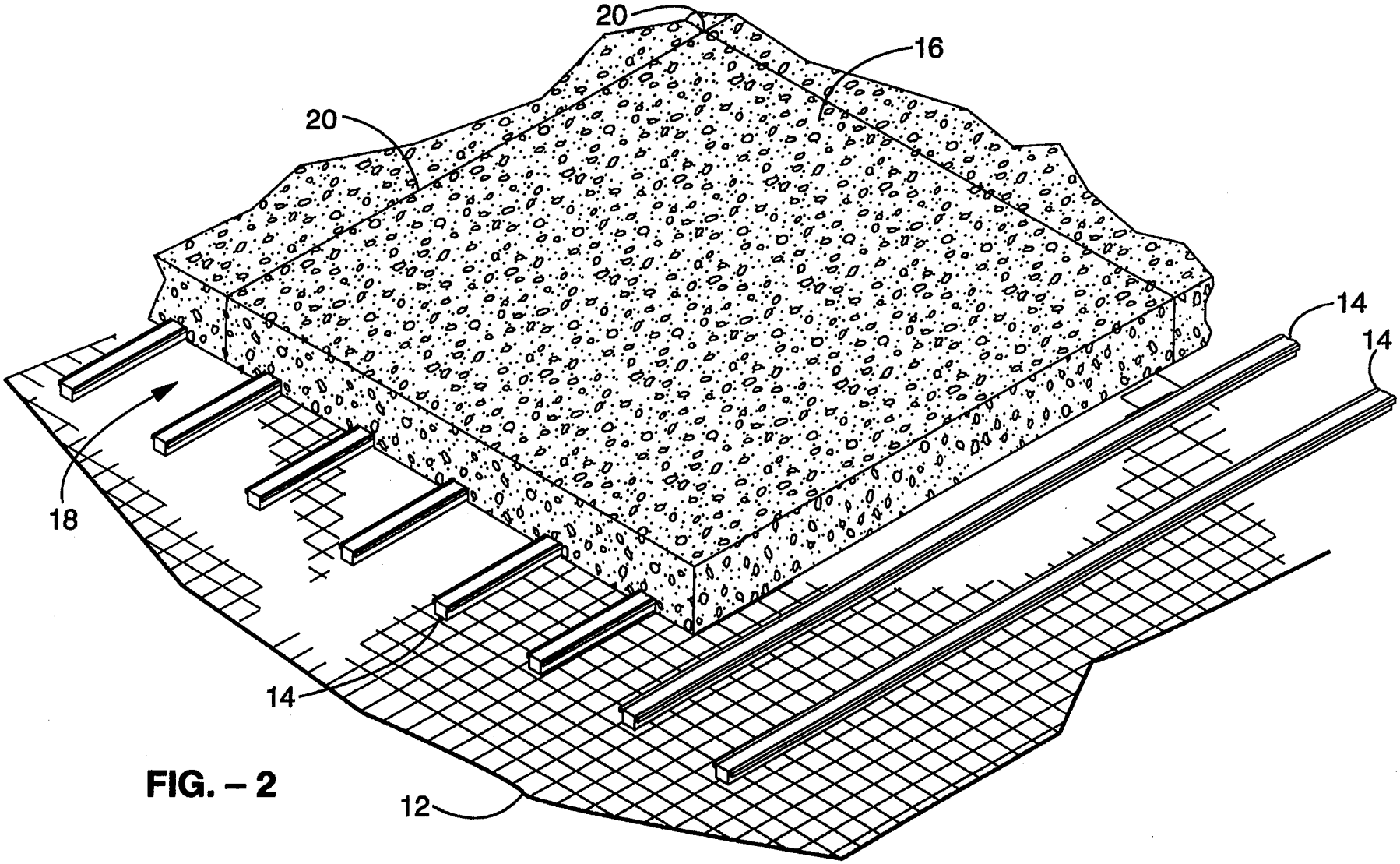
FIG. 2 is a detailed perspective view showing a section of the apparatus of FIG. 1.

As can be seen in FIG. 1 and FIG. 2, the surface paving apparatus 10 of the present invention includes a mesh underlayment material 12 to which a plurality of ribs 14 extending upward from the surface of the mesh material 12 are attached. The ribs 14 are preferably elongate and preferably laid in a substantially parallel configuration, and a paving material 16 is then pressed upon the ribs 14 until a tight frictional engagement is achieved. The ribs 14 are positioned on the mesh material 12 so as to permit a plurality of paving material sections to be used to establish a paved surface. The edges of adjacent sections of paving material 16 overlap the ribs 14. This overlap 18 allows the edges of adjacent sections of paving material 16 to abut against each other, thus reducing the size of gaps 20 between adjacent sections of paving material 16. The tight abutment of the sections of paving material against each other along with the immovable nature of the finished paving surface, reduces or eliminates the necessity to place mortar or sand in the gaps to achieve an immovable surface. The sections of paving material 16 may be selected from a number of types and compositions but, in the preferred embodiment, are composed of materials commonly used in the landscaping art.

Figure 3:
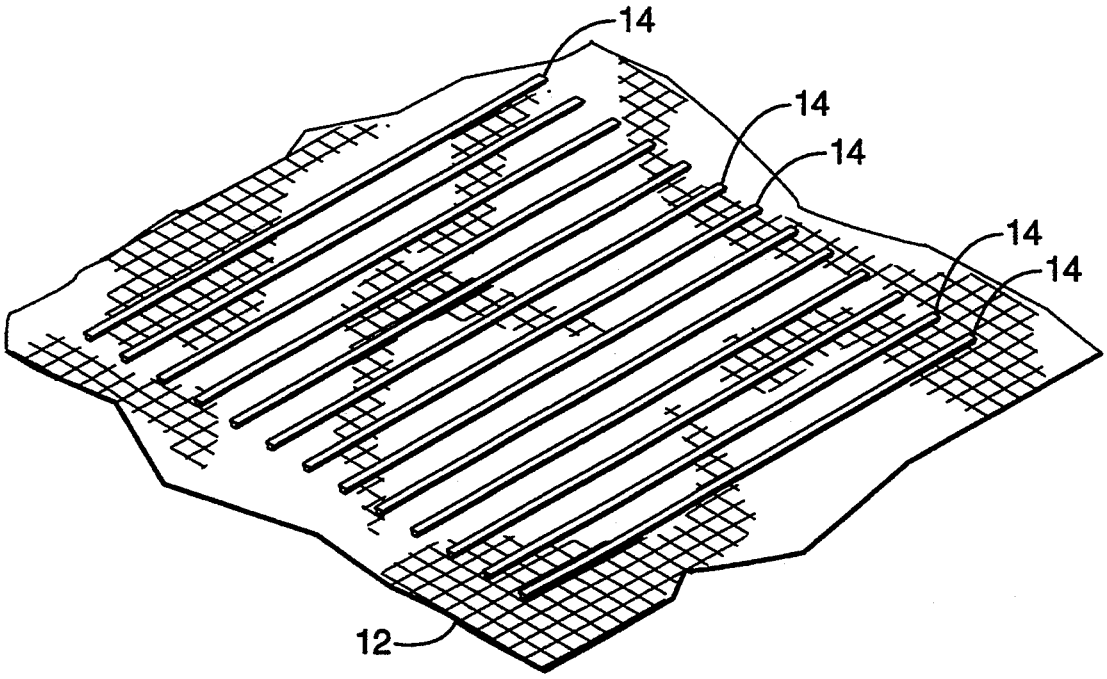
FIG. 3 is a perspective view of the mesh material and rib components of the apparatus of FIG. 1.
Figure 4:
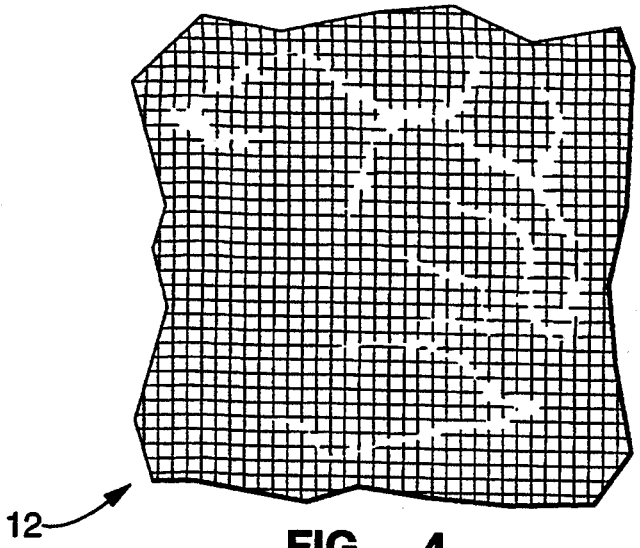
FIG. 4 is a detailed plan view of a section of the mesh material component of the apparatus of FIG. 1.

Referring now to FIG. 3, the apparatus is shown laying upon a surface to be paved, without the paving material 16 attached. The ribs 14 are shown as laying in a substantially parallel configuration upon the mesh material 12. The ribs 14 may be attached to the mesh material 12 either prior to practicing the invention, or else as part of an invention step. The mesh material 12 is porous in the preferred embodiment, but may be replaced with a non-porous, non-mesh material, as well. The mesh material 12 is illustrated in more detail in FIG. 4, where the preferably porous nature of the mesh material 12 is shown. The porous nature of the mesh material 12 allows for the drainage of water or other liquids away from the surface paving apparatus 10. It also provides for evaporation of moisture beneath the surface paving apparatus 10. An additional feature of the mesh material 12 is that it prevents the growth of weeds or other plants which can degrade the surface paving apparatus 10. The mesh material 12 may be selected from any number of suitably porous materials, but is preferably selected from any one of a number of woven landscape fabrics commonly used in the landscaping arts for erosion control, weed control, paving underliners and the like.

Figure 5:
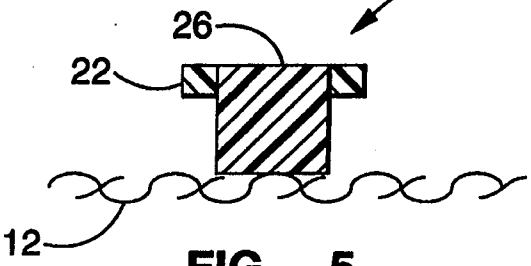
FIG. 5 is an end view of one of the rib components of the apparatus of FIG. 1.

Referring to FIG. 5, the structure of the ribs 14 may be more closely examined. The ribs 14 may be fashioned in a variety of sizes or shapes. However, with regards to shape, those shapes which closely approximate a rectangular configuration are preferred. Ribs 14 may be fastened to the mesh material 12 by any number of means including molding or laminating but, in the preferred embodiment, the ribs are fastened to the surface of the mesh material 12 by adhesive means. FIG. 5 shows the preferred embodiment of the ribs 14 being composed of a rigid center 26 and strips 22 running longitudinally along the upper edges of the rigid center 26. The strips 22 are made of a suitable frictional material. In the preferred embodiment, vinyl is the frictional material of choice for the strips 22. The strips 22 serve as a frictional gripping surface, and are fastened to the rigid center 26 of ribs 14 by any number of fastening means including adhesive means, in the preferred embodiment. Alternatively, ribs 14 could be molded as a one-piece structure having this configuration. The rigid centers 26 may be composed of a plurality of materials, flexible plastics being preferred. It is also within the contemplation of this invention, that the ribs 14 be composed of a rigid center 26 where the strips 22 are replaced by a frictional material which completely surrounds the rigid center 26. In an alternative embodiment, it is also contemplated that the ribs 14 be molded or laminated to the mesh material 12. In another embodiment, it is contemplated that the ribs 14 be of a compressible nature. Additionally, it is contemplated that the frictional strips 22 have a "feathered" surface which allows the frictional surface to have a larger surface area, and thereby provide more area to engage the paving material 16. Finally, as an alternative to the two-material plastic center/vinyl strip preferred embodiment of the ribs 14, it is contemplated the ribs be composed of a single material which has the requisite rigidity, flexibility, and frictional capacity required by this invention. The functioning of the strips 22 is more clearly illustrated in FIG. 6, FIG. 7, and FIG. 8.

Figure 8:
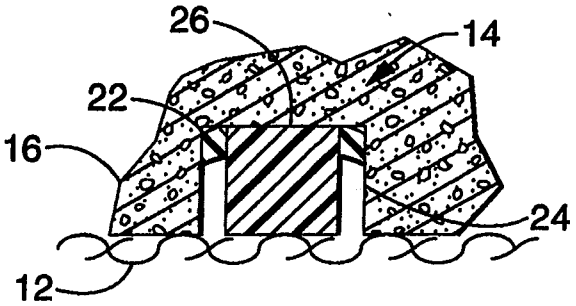
FIG. 8 is a detailed view showing a section of the assembly of FIG. 7.
Figure 6:
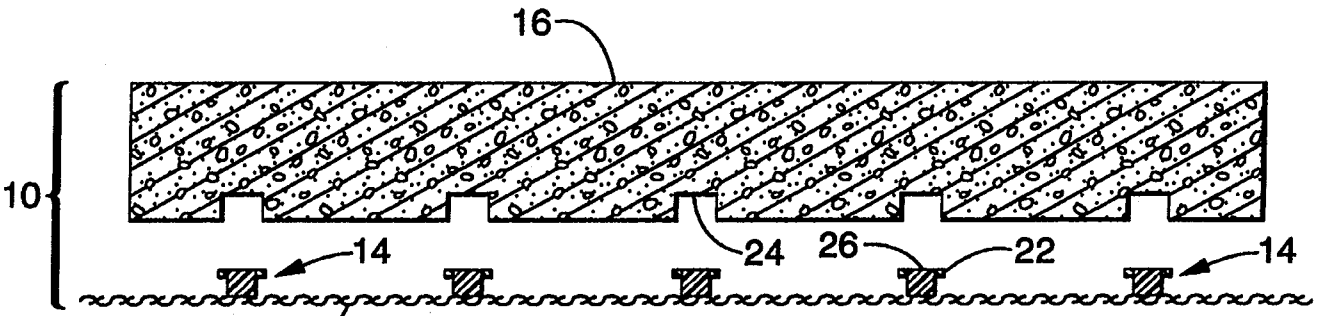
FIG. 6 is a side elevation view of the apparatus of FIG. 1, prior to engaging the paving material with the remainder of the present invention.
Figure 7:
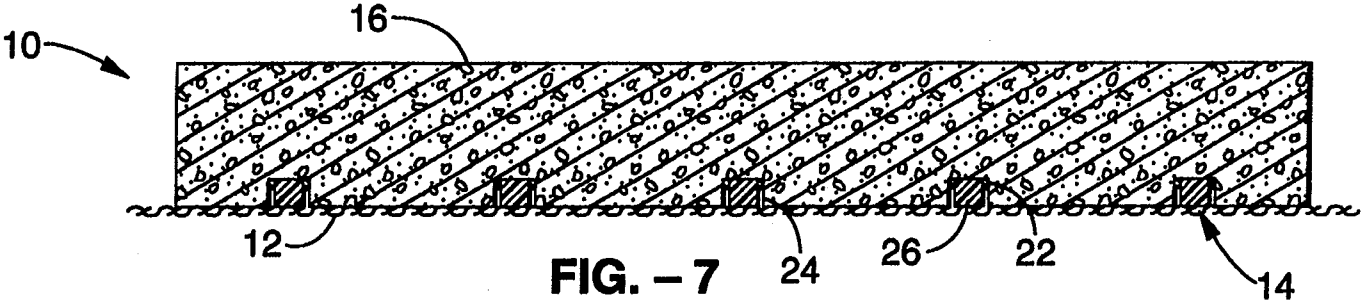
FIG. 7 is a cross-sectional view of the apparatus of FIG. 1 taken through line 7—7 and showing the frictional engagement of the rib and groove components.

Referring to FIG. 6, the relationship of the paving material 16 is shown prior to engagement upon the ribs 14. FIG. 7 and FIG. 8 illustrate the invention after achieving a tight frictional engagement between the strips 22 and grooves 24 in paving material 16. The rigid centers 26 of ribs 14 impart the necessary structural integrity to the ribs 14 such that the grooves 24 can easily engage upon the ribs. The frictional engagement between the strips 22 and the grooves 24 is such that, when a plurality of paving material sections 16 are placed upon the mesh material 12, the entire pavement surface apparatus is immovable laterally, from any direction. Preferably, each groove 24 in paving material 16 will be engaged to a corresponding rib 14 for maximum prevention against lateral movement. The grooves 24 may be of a plurality of shapes, rectangular being the preferred shape. The grooves 24 may be placed into the paving material 16 as part of an invention step, or the grooves 24 may be a previously existing feature of the paving material 16. The grooves 24 may be placed into the paving material 16 by any number of methods including cutting and extruding.

The method of practicing this invention involves the user placing the mesh material 12 with ribs 14 attached upon a surface to be paved. The ribs 14 may be previously attached to the mesh material 12 or, in the alternative, the user may place the ribs 14 upon the mesh material as part of an invention step. Next, the user must lay down the sections of paving material 16 to create a paving surface. The grooves 24 may be placed in the paving material 16 prior to practicing the invention or the grooves 24 may be placed in the paving material 16 as part of an invention step. Next, the user must couple the paving material 16 to the ribs 14 by pressing the ribs 14 into the grooves 24 of the paving material 16. When enough pressure is applied, the strips 22 on the ribs 14 will contact the inner walls of the grooves 24, creating a tight frictional engagement. A preferred method for coupling the paving material 16 to the ribs 14 is to position the paving material 16 into place by hand or by lightly tapping an edge, and then lightly tapping the top of the paving material 14 with a striking implement until a tight frictional engagement is achieved between the paving material and the ribs. Subsequently, this method may be repeated for numerous sections of paving material 16, as well as with numerous sections of mesh material 12 until a substantial paving surface is achieved. Once the apparatus is assembled, the flexible nature of the ribs 14 along with the mesh material 12, allows the apparatus to flex and accommodate large roots or other surface anomalies which may develop beneath the apparatus. Additionally, this surface paving apparatus can be disassembled by breaking the frictional engagement between the ribs 14 and the sections of paving material 16. Upon detaching the sections of paving material 16, the entire surface paving apparatus 10 may be moved and reassembled in another location.

Accordingly, it will be seen that this invention provides a surface paving apparatus and a method of paving a surface, which allows the user to readily apply an immovable paving surface to a variety of surfaces, including sloped surfaces and surfaces having minor elevational changes. The user will find that the frictional engagement of the pavement surface to the underlying mesh material is so immovable, that the necessity to use cement borders and/or packing the gaps between the sections of paving material with sand or other filler material, to create immovability, is obviated.

Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. An apparatus for paving a surface, comprising:
(a) a flexible underlayment material;
(b) a plurality of ribs fastened to and extending upward from said underlayment material, wherein each of said ribs includes a rigid center, and wherein each of said ribs includes two longitudinal sides, each of said sides having a strip of frictional material fastened thereto; and
(c) a paving material having a plurality of grooves, wherein said grooves detachably receive said ribs and frictionally couple said paving material to said underlayment material.

2. An apparatus for paving a surface, comprising:
(a) a flexible, porous, underlayment material;
(b) a plurality of ribs fastened to and extending upward from said underlayment material, wherein each of said ribs includes a rigid center, and wherein each of said ribs includes two longitudinal sides, each of said sides having a strip of frictional material fastened thereto; and
(c) a paving material having a plurality of grooves, wherein said grooves detachably receive said ribs and frictionally couple said paving material to said underlayment material.

3. An apparatus for paving a surface, comprising:
(a) A flexible, non-porous, underlayment material for covering a surface to be pave;
(b) a plurality of ribs fastened to and extending upward from said underlayment material, wherein each of said ribs includes a rigid center, and wherein each of said ribs includes two longitudinal sides, each of said sides having a strip of frictional material fastened thereto; and
(c) a paving material having a plurality of grooves, wherein said grooves detachably receive said ribs and frictionally couple said paving material to said underlayment material.

4. An apparatus as recited in claim 1, 2, or 3, wherein said frictional material is compressible.

5. An apparatus for paving a surface, comprising:
(a) a flexible underlayment material;
(b) a plurality of compressible ribs fastened to and extending upward from said underlayment material; and
(c) a paving material having a plurality of grooves, wherein said grooves detachably receive and compress said ribs, and wherein said grooves frictionally couple said paving material to said underlayment material.

6. An apparatus for paving a surface, comprising:
(a) A flexible, porous, underlayment material;
(b) a plurality of compressible ribs fastened to and extending upward from said underlayment material; and
(c) a paving material having a plurality of grooves, wherein said grooves detachably receive and compress said ribs, and wherein said grooves frictionally couple said paving material to said underlayment material.

7. An apparatus for paving a surface, comprising:
(a) A flexible, non-porous, underlayment material for covering a surface to be paved;
(b) a plurality of compressible ribs fastened to and extending upward from said underlayment material; and
(c) a paving material having a plurality of grooves, wherein said grooves detachably receive and compress said ribs, and wherein said grooves frictionally couple said paving material to said underlayment material.

8. An apparatus as recited in claim 1, 2, 3, 5, 6, 7, wherein said ribs are substantially elongate and oriented in a substantially parallel relation to each other.

9. An apparatus as recited in claim 1, 2, 3, 5, 6, 7, wherein said ribs are molded to said underlayment material.

10. An apparatus as recited in claim 1, 2, 3, 5, 6, 7, wherein said ribs are laminated to aid underlayment material.

11. An apparatus as recited in claim 1, 2, 3, 5, 6, 7, wherein said ribs are formed from a plastic material.

12. An apparatus as recited in claim 1, 2, 3, 5, 6, 7, wherein said frictional material is vinyl.

13. An apparatus as recited in claim 1, 2, 3, 5, 6, 7, wherein said paving material comprises a plurality of paving blocks.

* * * * *